United States Patent [19]

Segalman

[11] Patent Number: 4,612,988

[45] Date of Patent: Sep. 23, 1986

[54] DUAL AQUAFER ELECTRICAL HEATING OF SUBSURFACE HYDROCARBONS

[75] Inventor: Daniel J. Segalman, Plano, Tex.

[73] Assignee: Atlantic Richfield Company, Los Angeles, Calif.

[21] Appl. No.: 747,752

[22] Filed: Jun. 24, 1985

[51] Int. Cl.[4] ..... E21B 36/04; E21B 43/20; E21B 43/24

[52] U.S. Cl. ..... 166/248; 166/60; 166/268

[58] Field of Search ..... 166/248, 60, 269, 258, 166/65.1, 268; 219/415, 417

[56] References Cited

U.S. PATENT DOCUMENTS

| | | | |
|---|---|---|---|
| 3,180,413 | 4/1965 | Willman | 166/269 X |
| 3,862,662 | 1/1975 | Kern | 166/248 |
| 3,958,636 | 5/1976 | Perkins | 166/248 |
| 4,010,799 | 3/1977 | Kern et al. | 166/248 |
| 4,084,637 | 4/1978 | Todd | 166/248 |
| 4,484,627 | 11/1984 | Perkins | 166/248 |
| 4,499,948 | 2/1985 | Perkins | 166/248 |

*Primary Examiner*—Stephen J. Novosad
*Attorney, Agent, or Firm*—M. David Folzenlogen

[57] ABSTRACT

Electrical current is caused to flow between an electrode well located in an aquafer above viscous hydrocarbon-bearing formation and an electrode well located in an aquafer below the hydrocarbon-bearing formation. The electrical current thereby tends to spread out in a broad plate-like configuration from each electrode well. This increases the area of the hydrocarbon-bearing formation through which current is flowed, thereby extending the region which is heated by electrical dissapation. The nature of the aquafers and their location eases and resolves much of the adverse vaporization and pressure buildup that occurs in other systems. This also allows water to be readily injected to into or produced from the electrode wells to further control vaporization and pressure buildup without adversely affecting gravity drainage, other drive mechanisms or injection programs operating within the hydrocarbon-bearing formation. In addition, this enables the electrode wells to be used in a more continuous manner.

6 Claims, 1 Drawing Figure

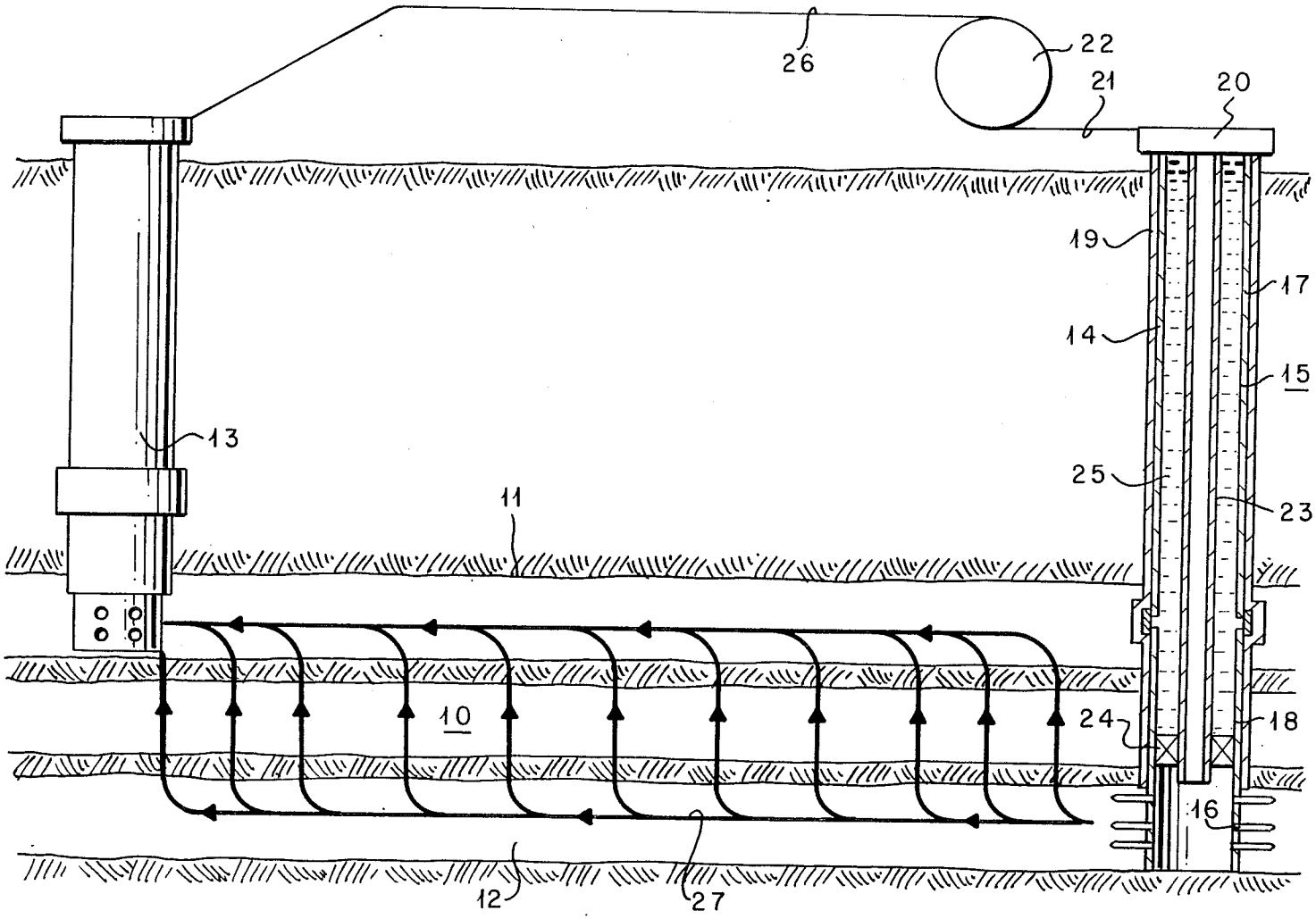
20
17
15
23
18
16
22
21
19
14
25
24
26
27
11
12
10
13

DUAL AQUAFER ELECTRICAL HEATING OF SUBSURFACE HYDROCARBONS

BACKGROUND OF THE INVENTION

This invention relates to an improved method for using electricity to stimulate production of viscous hydrocarbons from a subsurface formation. More particulary, electrical current is applied in a broaden horizontal plate-like manner to a subsurface hydrocarbon-bearing formation through electrode wells completed in relatively high permeability, large volume aquafers containing mobile water. The aquafers overlay and underlay oil-bearing formation.

For many years, it has been known that large deposits of relatively shallow, viscous oil are present in subterranean formations. Normally, the viscous oil is produced through a vertical production well. The well productivity is nearly inversely proportional to the viscosity of the oil. It has been proposed to use electrical current to add heat to a subsurface pay zone containing tar sands or viscous oil to render the viscous hydrocarbon more flowable. Electrodes are connected to an electrical power source and positioned at spaced apart points in contact with the earth. Currents up to 1,800 amperes are passed between the electrodes. This heats oil in the formation. Electrical power utilizes energy from various sources. This energy is expended for and in a sense is replaced by viscous oil. Therefore, the relative success of electric heating depends on the amount of oil produced per unit of electrical power supplied. Unfortunately, most of the heat occurs adjacent to the electrode wells and heat transfer outward into the formation by conduction is slow. Moreover, the power efficiency of electrical generation is only about one-third. Brine injection and fractures have been suggested for decreasing electrode resistance and increasing electrode radius. Moreover, it has been proposed to use the electrode wells as water injection wells in well patterns based in part on the number of phases of the electricity used to apply heat to the formation. Such patterns have been used in conventional ways and their efficiency, therefore, is less than it could be. Moreover, when the electrode wells are completed into the producing formation, injection of fluids into or production of fluids from the hydrocarbon-bearing formation through the electrode wells interferes with normal gravity drainage, other drive mechanisms, and/or injection programs. It, therefore, would be advantageous to provide a method for stimulating the viscous oil production that does not interfere with optimizing the way that the hydrocarbon formation is produced.

In U.S. Pat. No. 3,862,622, it has been proposed to place electrodes in upper and lower layers situated immediately above and below a subsurface hydrocarbon-bearing formation. The upper and lower layers have a lower electrical resistivity than that of the formation to be produced. The resistivity of a subsurface layer is dependent upon a number of factors. For example, many subsurface layers are made up of hydrated minerals or contain what is called connate water. Connate water and water in salts is not mobile water. A layer may have lower resistivity than an oil bearing formation without containing mobile water. U.S. Pat. No. 3,862,622, therefore, sets forth several electrode completion techniques wherein water from the surface of the earth is used. For example, voids or cavities are filled with an electrolyte such as aqueous sodium chloride solution to increase the effective radius of the electrode. The voids or cavities can be created by hydraulic fracturing and propped with propping agents or by considerably enlarging the diameter of the bottom portion of the well which is left uncased.

By computer modelling experiments, it has been demonstrated that the effectiveness of these prior electrodes with limited water volumes for electrical heating of viscous oil-bearing formation is seriously limited. In such confined, limited water volume electrodes, it is difficult to resolve the adverse effects of boiling fluids adjacent the electrode. Vaporization and pressure buildup adjacent the electrode limits and adversely affects the amount of electric current that can be flowed through a subsurface formation.

SUMMARY OF THE INVENTION

It is the primary object of this invention to provide a method of electrically heating hydrocarbons in a subsurface formation in a more efficient and more complete manner.

In accordance with this invention, electrical voltage is applied to electrode wells and current is caused to flow between an electrode well located in an aquafer above and sufficiently close to a viscous hydrocarbon-bearing formation and an electrode well located in an aquafer below and sufficiently close to the viscous hydrocarbon-bearing formation. The electrical current thereby tends to spread out in a broad plate-like configuration from each electrode well. This increases the area of the hydrocarbon-bearing formation through which current is flowed. This extends the region which is heated by electrical dissapation. It eases and resolves much of the boiling problem that occurs in prior systems. In this invention, water may readily be injected to into or produced from the electrode wells to further control vaporization and pressure buildup. The electrode wells are not in the oil-bearing formation; therefore, water injection into or production from the electrode wells does not interfere with gravity drainage, other drive mechanisms or injection programs operating within the hydrocarbon-bearing formation. Moreover, it enables the electrode wells to be used in a more continuous manner.

BRIEF DESCRIPTION OF THE DRAWING

The drawing is a cross section of two aquafers and a subsurface hydrocarbon-bearing formation and a partial cross section of two electrode wells located in the aquafers.

DESCRITPION OF PREFERRED EMBODIMENTS

This invention describes a dual aquafer method of stimulating oil production from viscus hydrocarbon-bearing subsurface formation 10. The method is suitable to be practiced in any formation containing viscus oil whose viscousity is susceptible to significant reduction and increase mobility at temperatures achievable by electrical formation heating provided that the oil bearing formation is over lain by aquafers 11 and 12.

For purposes of this invention, the word "aquafer" refers to a subsurface zone or formation that naturally contains a relatively high volume of mobile brine water and has sufficiently high permeability to readily permit the flow of water into and out of the aquafer. The word "aquafer" further means that each aquafer has sufficient lateral extent above and below an oil bearing formation to permit electrode wells 13 and 14 to be laterally spaced by distances greater than 100 feet. This lateral distance enables the electrical current to flow in a broad plate-like configuration extending the region over which electrical current may flow between the aquafers through the oil bearing formation. This results in a broaden heating zone. Flowable mobile water in relative large volume is required to ease and resolve vaporization problems near the electrode wells where it is designed that the current be high but the resistance be lower than normal. The requirement of flowable mobile water is also needed to enable the injection of water or production of water from each aquafer to ease local boiling and pressure buildup. For example, as to water injection, an aquafer (as defined) does not have the the permeability and viscosity differences with respect to water that exist in viscous oil-bearing fomations. By way of further example, an aquafer (as defined) contains a large supply of mobile water. Production of water from an aquafer assures adequate capability of producing water to ease and resolve boiling and pressure buildup problems. This also eliminates the need to turn off the power during of moments of production. In viscous oil zones, the production of formation liquids must be controlled.

In order to prepare the formation for practice of the process of this invention, a portion or all of the oil formation will be selected for electrical stimulation. Selection of the location and size of the area to be produced depends on many factors, but for purposes of this invention it is primarily depended on selection of an oil-bearing portion of the formation which is underlain and overlain by aquafers which are sufficiently close to the oil-bearing formation to permit the flow of electrical current through the formation. Wells 13 and 14 may be completed in any manner suitable for the purposes hereinafter stated, for example, in the manner set forth in U.S Pat. No. 4,484,627. The wells may be completed in the formation in a manner such that the effective radius of the well exceeds the effective radius of an essentially vertical well. This increase in effective radius may be provided by drilling an enlarged borehole and gravel packing it or by one or more slanted or horizontal boreholes extending laterally into and across each aquafer. Although these and other conventional forms of electrodes may be used, it is expected that the wells be cased and that the electrodes and the upper part of the casing will be used as an electric conductor. If alternating current is used, in order to reduce the magnetic hysteresis losses, the upper part of the casing may be comprised of a non-magnetic metal, such as, for example, stainless steel or aluminum. Corrosion and premature loss of power to the overburden or underburden may be prevented by electrically insulating the exterior of the casing with nonconductive cement, coatings, pipe wraping, extruted plastic, heat shrinkable sleeves, or other similar non-conducting corrosion protection materials.

It is to be noted that it is important that well 14 which extends into lower aquafer 12 be insulated electricly from upper aquafer 11. It is also preferred that it be electrically isolated from oil-bearing formation 10.

Accordingly, in the drawing for illustration purposes, electrode well 14 is shown with metal casing string 15 extending from near the surface of the earth downwardly to aquafer 12 where the electrode is to be located so that currents up to 1800 amperes may be passed into aquafer 12. The casing is shown perforated at 16 to permit the flow of water from and into the aquafer. In the drawing, the part of the casing electrically exposed to and in contact with the aquafer is used as the electrode and the part above the aquafer is used as an electric conductor. Casing 15 is comprised of casing sections and is divided into an upper casing portion 17 and lower portion 18 which includes the part of the casing that acts as the electrode. In order to reduce the overall impedance of the transmission system and reduce magnetic hysterisis, upper casing portion 17 is comprised of a non-magnetic metal. Corrosion and premature loss of power and the overburden and especially to the upper aquafer 11 and oil-bearing formation 10 are effectively prevented by electrically insulating the upper casing portion with outer electrical insulation 19. Upper casing 17 is shown connected to a typical christmas tree represented by block 20. The christmas tree is shown electrically connected via conductor 21 to power source 22. Power source 22 is capable of generating up to several thousands volts. Typically, a well include surface casing (not shown) which extends to fresh water zones to a predetermined point and is sealed in place with cement. Shown inside of electrode well 14 is tubing string 23 which permits the injection of water into and the production of water out of aquafer 12. The tubing string is set with packer 24 at a point inside the lower casing string below the lowest point of the upper casing string. After the packer is set, electrically non-conductive fluid 25 may be added to the annulus between tubing and casing above the packer. This electrically insulates the interior surface of the desired portion of electrode well 14.

As shown, power source 22 is also connected to electrode well 13 via line 26 so that electrical current may be flowed between electrode wells 13 and 14. Electrode well 13 is completed in similar fashion as to electrode well 14 except that electrode well 13 extends only into the upper aquafer.

In operation electric voltage from power source 22, for example, pulsating DC, are single or polyphase eccentric or regular AC of any suitable number of cycles per second will be applied between the two electrode wells. The voltage and current applied between the electrode wells is primarily dependent upon the relative electrical conductivities of the aquafers and oil-bearing formation and the amount of heat to be applied to the oil-bearing formation, including the desired temperature of the oil. Usually, about 150° F. to 200° F. is preferred. Polyphase eccentric or regular low frequency alternating current is much preferred for its greater efficiency, but because the wells are placed in aquafers of high electrical conductivity with readily flowable waters, DC may be used. Switching and voltage control means will be used to control application, duration and magnitude of the voltage current between the electrode wells. Because the wells are completed into aquafers containing mobile water of high conductivity, the current spreads out in a broad plate-like configuration extending the region through which the electric current passes at a high current rate. Computer modelling has shown that this plate-like effect occurs. The current pattern determined by computer modelling is indicated in the drawing by arrows 27 which assume that at that instant one electrode is positive and one is negative. This results in a broader extent of current flow and a broaden heating zone in the oil.

The very fact that the electrode wells are completed into relatively high permeability, large volume aquafers containing adequate flowable mobile water eases and does much to resolve the local over-heating, vaporization and excessive pressure buildup observed with normal electrode completion techniques and electric heating systems. However, since higher current densities and current flow rates can be achieved with the dual aquafer system of this invention, boiling, vaporization, pressurization and other adverse effects may at times and under certain conditions still be limiting. The process of this invention readily permits the injection of water into or the production of water out of the formation for controlling and resolving these periodic problems. Therefore, the process of this invention may also include simultaneous electrically heating and water injection or simultaneous electricallyy heating and water production from one or more of the aquafers. It is to be noted that because the elecrode wells are completed in relatively high permeability, large volume aquafers containing flowable mobile water, the injection of water into each aquafer is readily accomplished because each aquafer has high permeability and because the viscosity of the injected water is the same as or similar to the viscosity of the aquafer water. Viscous oil-bearing formations generally have very low permeability to water flow. In viscous oil-bearing formations, the viscosity of the oil is radically different from that of water. Similarly, because the aquafers (as defined) contain a large supply of flowable mobile water, water may be produced from the aquafer in large volumes to control adverse local effects of the high current. Since the electrode wells are not in the oil-bearing formation, water injection or production may achieved without affecting drainage, injection programs and other drive mechanisms operating within the oil-bearing formation. From the foregoing, it can be seen that this disclosure achieves the purpose previously mentioned. Although this invention has been described with a certain degree of particularity, it is to be understood the present disclosure has been made only by way of example and that numerous changes in the details of the constuction of the electrode wells and their spacing may be resorted to without departing from the spirit and scope of this invention.

What is claimed is:

1. A method of electrically heating a viscous hydrocarbon-bearing subsurface formation comprising:

a. applying an electric voltage to a first electrode well extending into a subsurface first aquafer, said first aquafer containing flowable mobile water and having sufficiently high permeability to permit water to be flowed into and out of said first aquafer, said first aquafer extending laterally more than 100 feet from said first electrode well in at least one direction and overlaying said viscous hydrocarbon-bearing subsurface formation;

b. applying an electric voltage to a second electrode well extending into a subsurface second aquafer, said second aquafer containing flowable mobile water and having sufficiently high permeability to permit water to be flowed into and out of said second aquafer, said second aquafer extending laterally more than 100 feet from said second electrode well in at least one direction and underlaying said viscous hydrocarbon-bearing subsurface formation, and c. causing electric current to flow between said first and second electrode wells and through said viscous hydrocarbon subsurface formation.

2. The method of claim 1 wherein simultaneously with steps "a" and "b", water is injected into one of said first and second electrode wells.

3. The method of claim 2 wherein simultaneously with steps "a" and "b", water is produced from the other of of said first and second electrode wells.

4. The method of claim 1 wherein simultaneously with steps "a" and "b", water is produced from one of said first and second electrode wells.

5. The method of claim 1 wherein simultaneously with steps "a" and "b", water is produced from both of said first and second electrode wells.

6. The method of claim 1 wherein simultaneously with steps "a" and "b", water is injected into both of said first and second electrode wells.

* * * * *